US009994985B1

(12) United States Patent
Scortegagna

(10) Patent No.: US 9,994,985 B1
(45) Date of Patent: Jun. 12, 2018

(54) COMPACTING MACHINE, POSITIONING DEVICE AND POSITIONING METHOD

(71) Applicant: LAFER SPA, Schio (VI) (IT)

(72) Inventor: Bruno Scortegagna, Schio (IT)

(73) Assignee: LAFER SPA, Schio (VI) (IT)

( * ) Notice: Subject to any disclaimer, the term of this patent is extended or adjusted under 35 U.S.C. 154(b) by 0 days. days.

(21) Appl. No.: 15/788,256

(22) Filed: Oct. 19, 2017

(30) Foreign Application Priority Data

Jun. 20, 2017 (IT) ..... 102017000068662

(51) Int. Cl.
*D06C 21/00* (2006.01)

(52) U.S. Cl.
CPC ..... *D06C 21/00* (2013.01)

(58) Field of Classification Search
CPC ..... D06C 21/00; D06C 21/005; D06C 15/00; D06C 15/02; D06C 5/04; D06C 15/08; B65H 2404/1441; B65H 2404/144; B65H 2404/14212; B65H 2404/14
USPC ..... 26/18.5, 18.6
See application file for complete search history.

(56) References Cited

U.S. PATENT DOCUMENTS 1,776,224 A * 9/1930 Hogan ..... B65H 23/0204 200/61.18
2,263,712 A * 11/1941 Wrigley ..... D06C 21/00 26/18.6
2,765,514 A * 10/1956 Walton ..... D03J 1/00 26/18.6
3,015,145 A * 1/1962 Cohn ..... D06C 21/00 26/18.6
3,015,146 A * 1/1962 Cohn ..... D06C 5/00 26/18.6
3,973,303 A * 8/1976 Diggle, Jr. ..... D06C 21/00 26/18.6
4,142,278 A * 3/1979 Walton ..... D06C 21/00 26/18.6
5,016,329 A * 5/1991 Milligan ..... D06C 5/00 26/18.5
5,117,540 A * 6/1992 Walton ..... D06C 21/00 26/18.6
5,553,365 A * 9/1996 Catallo ..... D06C 21/00 26/18.6
5,655,275 A 8/1997 Allison et al.
8,590,122 B2 11/2013 West et al.

* cited by examiner

*Primary Examiner* — Amy Vanatta
(74) *Attorney, Agent, or Firm* — Rankin, Hill & Clark LLP

(57) ABSTRACT

A compacting machine for compaction a fabric including a feed roller, a retarding roller and a blade element configured to introduce the fabric to be treated between the feed roller and the retarding roller. The compacting machine also comprises a positioning device provided with at least one drive member configured to move one of the rollers with respect to the other of the rollers.

9 Claims, 2 Drawing Sheets

COMPACTING MACHINE, POSITIONING DEVICE AND POSITIONING METHOD

FIELD OF THE INVENTION

The present invention concerns a positioning device applicable to a compacting machine for fabrics of the type comprising a retarding roller and a feed roller, and usable to regulate the position of the retarding roller with respect to the feed roller.

The invention also concerns the associated positioning method.

BACKGROUND OF THE INVENTION

In the textile finishing sector, so-called mechanical compacting machines are known, comprising as their main components a feed roller, or "rough" roller, and a retarding roller or "rubberized" roller, which rotates at a lower speed than the feed roller. The fabric to be compacted is normally guided between the two rollers by a shaped blade element.

Compaction of the fabric is determined by the combined action of the shaped blade element that guides the fabric between the feed roller and the retarding roller, and the retarding roller which, rotating more slowly, "slows down" the fabric and therefore compacts it in the direction of feed.

In order to correctly compact the fabric along its entire transverse extension, the retarding roller must be positioned in close proximity and kept as parallel as possible to the feed roller.

Moreover, the retarding roller frequently detaches and then needs to be brought closer to the feed roller, for example, at each passing of a seam in correspondence with the gap between the rollers.

The movement of the retarding roller is generally effected by one or more pneumatic actuators which drive some levers, as described for example in documents U.S. Pat. No. 5,655,275 and U.S. Pat. No. 8,590,122.

Generally, the retarding roller is made to rest on the rough feed roller by applying high pressure to it, so as to reduce the times needed to move it closer. Consequently, the retarding roller knocks rather violently against the rough feed roller, which, due to the difference in the peripheral speed of the two rollers, tends to cause abrasion on the rubber of the retarding roller not covered by the fabric.

In order to work the fabric correctly, in fact, the retarding roller must be brought very close to the rough roller and perfectly parallel to it, but possibly not in contact, otherwise the rubber is worn out in a very short time.

In known solutions, after having rested the retarding roller on the feed roller and thereby obtaining the parallelism between the two, the pressure in the pneumatic actuators that move the levers on which the rubberized roller is mounted is drastically reduced, so that it remains just resting on the feed roller and, due to the thickness of the fabric passing between them, the two rollers are no longer in contact with each other.

One disadvantage of this solution is the short duration of the rubberized retarding roller which has to be replaced/ground frequently.

In fact, the abrasion effect indicated above occurs every time the retarding roller detaches from the fabric, and hence from the feed roller, then returns closer to it, that is, every time there is a seam.

Considering that a compacting machine can work at a speed generally comprised between 30 and 50 m/min, and that in the fabric there is a seam in correspondence with each end of the piece, that is about every 50 m, it is possible to estimate the number of "jumps" that the retarding roller performs in a working day of about 12 hours.

At a minimum speed of 30 m/min, about 21,600 m of fabric per day will be processed, for a total of approximately 432 seams.

This means that for 432 times a day the retarding roller detaches from the fabric and from the feed roller, and then is thrust back against it with high pressure, as explained above. Although high pressure is applied only for a fraction of a second, however, it is sufficient to cause abrasion of the retarding roller at the points of contact with the feed roller.

It is therefore evident that in a compacting machine of this type, it is necessary to grind and/or replace the retarding roller very frequently, about every two months, with consequent economic losses deriving from machine downtimes needed to carry out maintenance.

To solve this problem, compacting machines have been produced, provided with a spacer device which prevents the retarding roller from contacting the feed roller during the closing step. The known spacer device comprises idle rings installed at the opposite ends of the shaft of the feed roller. The rings have a slightly larger diameter than the diameter of the feed roller. In this way, when the retarding roller is thrust against the feed roller, there is a contact between the rings and the retarding roller, so that the retarding roller remains distanced from the feed roller and is free to rotate at a different speed without sliding against the rough surface of the feed roller.

One disadvantage of this known solution, however, is the fact that, to modify the distance between the retarding roller and the feed roller, for example depending on the thickness of the fabric to be treated, complicated operations are required to disassemble and reassemble the rings, which require the machine to be stopped in order to access the rings and replace them with others of different diameter. Also, changing the positioning distance between the rollers can in no way be automated.

One purpose of the present invention is to obtain a compacting machine provided with a positioning device for the rollers which overcomes at least one of the disadvantages of the state of the art.

In particular, the purpose of the invention is to reduce the problems associated with repeated sliding of the rubberized retarding roller with respect to the rough feed roller, and hence the consequent premature wear of the rubberized roller.

Another purpose is to obtain a positioning device that is highly reliable and which allows to repeat the correct positioning of the retarding roller with respect to the feed roller without them ever being in contact.

Another purpose of the present invention is to obtain a positioning device that can be regulated automatically and that allows for easy and rapid change of the reciprocal distance between the rollers.

One purpose of the present invention is also to provide a positioning device that is versatile and whose drive can be programmed according to the thickness, or type of fabric to be treated, and the degree of compaction required.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, one embodiment of the invention concerns a compacting machine for fabrics of the mechanical type, provided with a feed roller, a retarding roller and a shaped blade element, configured to introduce the fabric to be treated into the gap defined between the feed roller and the retarding roller.

According to one aspect of the present invention, the compacting machine also comprises an adjustable positioning device, provided with at least one drive member, and configured to position, automatically, a first roller with respect to a second roller, for example the retarding roller with respect to the feed roller, or vice versa, moving it closer and parallel to it at a desired minimum distance other than zero.

In this way, the retarding roller is never in contact with the feed roller, either in an operative condition, in which the rollers are close to each other, or in the passage between a non-operative open condition, in which the retarding roller is distant from the feed roller, and the operative condition.

Hereafter in the description and the drawings, reference will be made to a positioning device applied to the retarding roller, but it can be provided that this is applied in an equivalent manner to the feed roller.

According to some embodiments, the adjustable positioning device comprises an abutment member integral with the retarding roller, and a stop member positionable to mechanically limit the movement of the retarding roller so that between the retarding roller and the feed roller a desired distance other than zero is defined.

In one embodiment, the position of the stop member can be set manually by an operator on the basis of pre-established tables.

In another embodiment, the position of the stop member can be set by acting on a user interface by means of which the desired distance can be set between the rollers during the operative step.

In yet another embodiment, the positioning device can be self-regulating on the basis, for example, of parameters set by the operator on the type and size of the fabric to be treated, or on the compaction treatment to be carried out, or other.

In one embodiment, the abutment member is directly associated with the drive member, for example an actuator, that moves the retarding roller.

According to possible solutions, two abutment members are provided cooperating with two respective stop members, each disposed in correspondence or in proximity with one end of the retarding roller, in order to guarantee that it is positioned perfectly parallel to the feed roller.

According to other embodiments, the abutment member is a lever connected at its first end with the retarding roller and at its second end with the drive member.

In one embodiment, the lever is constrained to a fixed pin and is rotatable on a plane orthogonal to an axis of rotation defined by the pin as a function of the action of the drive member, consequently moving the retarding roller closer to/away from the feed roller.

According to some embodiments, the abutment member comprises an end-of-travel portion which, during the movement of the retarding roller, is thrust against the stop portion of the stop member, in order to stop the travel of the retarding roller toward the feed roller when the minimum distance between the two has been reached.

According to possible solutions, the stop member is a motorized centesimal feeler. This allows to be able to regulate the height of the stop portion, also automatically, so as to set a desired operative distance between the rollers as a function of the type, or thickness, of the fabric, or the level of compaction required.

According to some embodiments, the compacting machine also comprises a control and command unit provided with a user interface by means of which an operator can select a desired operative distance between the rollers. As a function of the distance selected, the control and command unit will therefore command the drive members of the feeler so as to position the stop portion at a height correlated to the selected operative distance.

As we said, the operator can also simply select a predetermined working to be carried out, inserting, for example, the type and thickness of the fabric, as well as the level of compaction to be done, and then the positioning device, in particular the stop member, will be automatically positioned to define the desired and pre-selected operative distance between the rollers.

Embodiments described here also concern a method to position the retarding roller with respect to the feed roller, wherein the method provides to move the retarding roller at least between a non-operative open condition in which it is distant from the feed roller and an operative condition in which it is close to it.

The method comprises an initial setting step to set a minimum distance between the retarding roller and the feed roller that provides to position a stop member at a defined height, said height being correlated to said minimum distance.

According to the invention, in order to move the retarding roller from the non-operative open condition to the operative condition, the method provides to drive the drive member to move the retarding roller, and therefore the abutment member associated with it, until it moves it close to the pre-set minimum distance from the feed roller.

The method can also provide a regulation step comprising the selection of an operative distance between the feed roller and the retarding roller, greater than or at least equal to the minimum distance, as a function of the type/thickness of the fabric and/or the degree of compaction required, and the corresponding regulation, possibly automatic, of the stop member, wherein a stop portion of the stop member is positioned, with respect to the set height, at an operative height correlated to the operative distance selected.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 2:
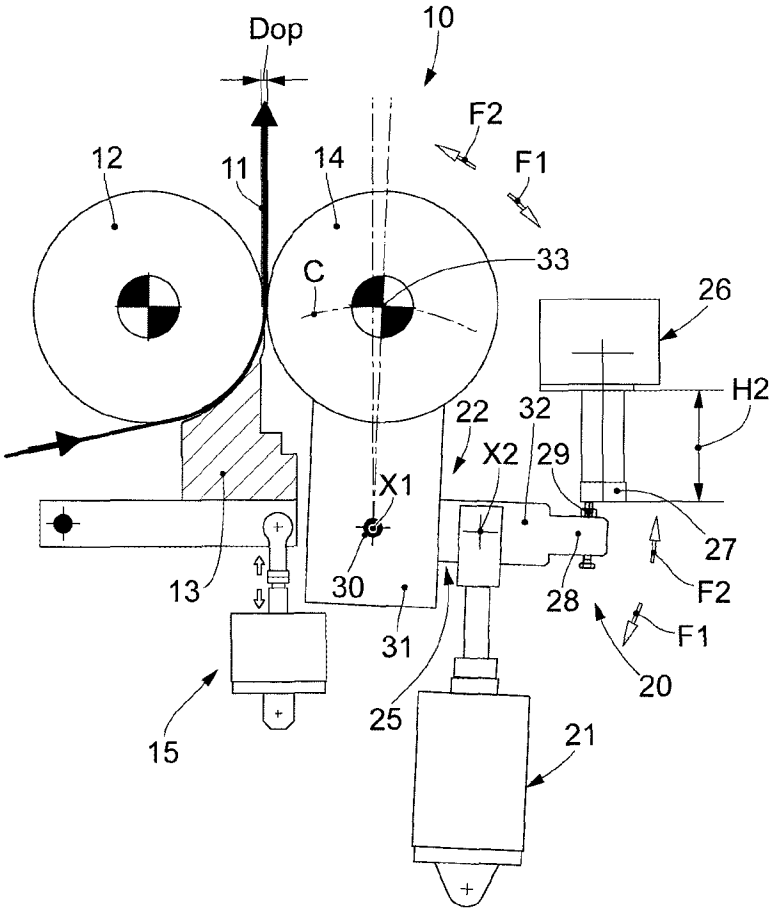
FIG. 2 is a schematic lateral view of a positioning device applied to a retarding roller of a compacting machine in a closed operative condition during the treatment of a fabric with a second thickness.

Embodiments described here concern a compacting machine 10 suitable to perform a mechanical compaction on a fabric 11.

The compacting machine 10 comprises, in a known manner, a feed roller 12, also called a "drawing" or "rough" roller, a retarding roller 14, also called a "rubberized roller", and a shaped blade element 13 configured to introduce the fabric 11 between the two rollers 12, 14.

According to some embodiments, movement means 15 can be provided, configured to move the shaped blade element 13 toward/away from the feed roller 12.

The feed roller 12 is coated in gripping material to facilitate gripping on the fabric 11 that is wound upon it, while the retarding roller 14, which rotates at a lower speed than the feed roller 12, is coated in rubber or similar material, so as to brake the fabric 11 and compact it thanks to the difference in speed between the two rollers 12 and 14.

The retarding roller 14 generally rotates at about half the speed of rotation of the feed roller 12.

Figure 1:
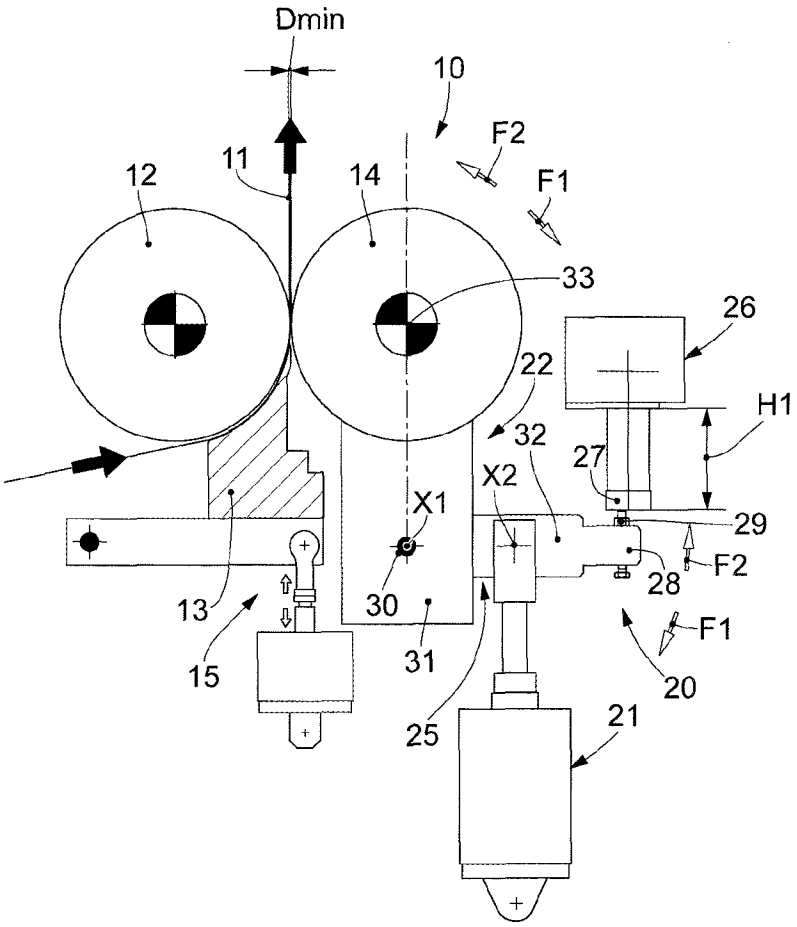
FIG. 1 is a schematic lateral view of a positioning device applied to a retarding roller of a compacting machine in a closed operative condition during the treatment of a fabric with a first thickness.

The retarding roller 14 is mobile away from/toward the feed roller 12 in the directions indicated by the arrows F1, F2 between a non-operative open condition (FIG. 3), where it is distant from the feed roller 12, and an operative condition in which it is adjacent to it (FIG. 1 and FIG. 2).

According to one aspect of the present invention, the compacting machine 10 comprises a positioning device 20, configured to automatically reposition the retarding roller 14 with respect to the feed roller 12 while at the same time guaranteeing that it is always at a desired minimum distance Dmin, other than zero, from the latter, both in an operative condition, and also in the passage between the non-operative open condition and the operative condition.

According to some embodiments, the positioning device 20 according to the invention is also configured to automatically regulate an operative distance Dop of the retarding roller 14 with respect to the feed roller 12, and to restore in a repeatable manner said operative distance Dop each time the retarding roller 14 moves away from the feed roller 12, for example due to the presence of a seam in the fabric 11 in transit.

According to some embodiments, the positioning device 20 allows to define a minimum distance Dmin between the feed roller 12 and the retarding roller 14, that is, between the respective outer surfaces, for example about 0.1 mm, that is, such as to allow the independent rotation, and at different speeds, of the two rollers 12, 14.

According to the embodiment shown here, merely by way of example, the positioning device 20 comprises a drive member 21 and an abutment member 22 connected on one side to the retarding roller 14 and cooperating with the opposite end with the drive member 21.

According to some embodiments, the drive member 21 can be a linear actuator configured to exert a defined pressure, for example a pneumatic roller.

For example, the drive member 21 can exert a pressure of about 6 bar such that the retarding roller 14 is rapidly brought back from the non-operative open condition to the operative condition, and in particular to the desired operative distance Dop with respect to the feed roller 12.

In the solution shown, the abutment member 22 also performs the function of transferring and transforming the linear motion provided by the drive member 21 into a circular motion of the retarding roller 14, in particular of the longitudinal axis of the retarding roller 14 on a plane orthogonal to the longitudinal axis itself.

Unlike the prior art solutions, in which the pneumatic roller exerts a pressure directly on the retarding roller 14, thrusting it forcefully against the feed roller 12, the positioning device 20 according to the present invention does not exploit the pressure exerted by the drive member 21 to move the retarding roller 14 toward the feed roller 12, but only to guarantee that it is correctly positioned and held in position.

In accordance with another aspect of the present invention, the positioning device 20 also comprises at least one stop member or feeler 26, configured to provide a mechanical abutment for the positioning device 20, and in particular for for the drive member 21, so as to guarantee that the retarding roller 14 always remains at the minimum distance Dmin with respect to the feed roller 12.

According to possible solutions, two stop members 26 are provided, each disposed in correspondence with or close to one end of a rotation shaft 33 of the retarding roller 14, so as to guarantee that it is positioned perfectly parallel to the feed roller 12.

According to some embodiments, the stop member 26 can comprise a stop portion 27 suitable to cooperate directly or indirectly with the drive member 21.

Figure 3:
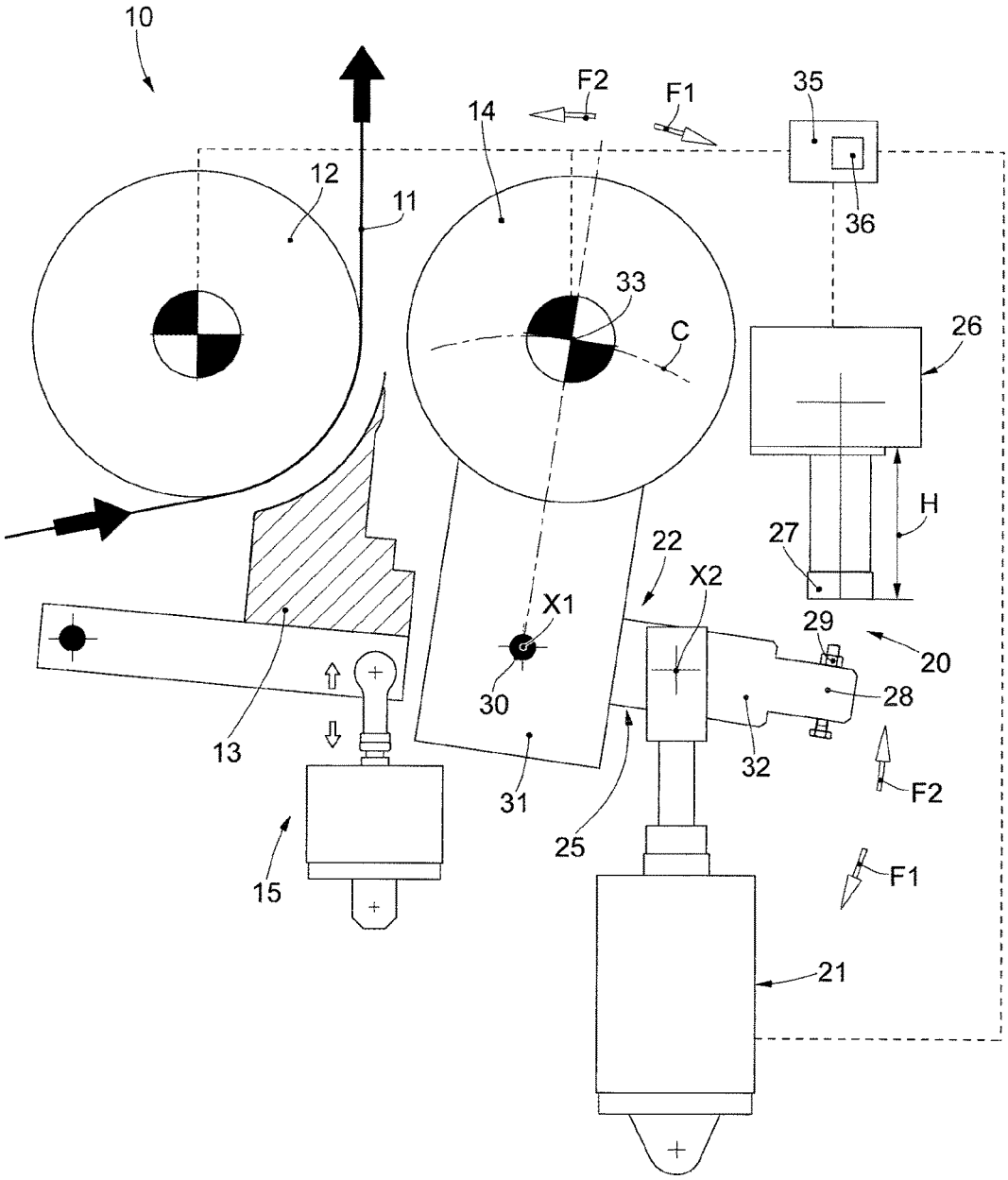
FIG. 3 is a schematic lateral view of a positioning device applied to a retarding roller of a compacting machine in a non-operative open condition.

According to embodiments shown, for example, in FIGS. 1-3, the stop member 26 can cooperate indirectly with the drive member 21 by means of the abutment member 22.

According to these embodiments, the abutment member 22 is provided with an end-of-travel portion 28 configured to contact the stop portion 27 of the stop member 26 to stop the travel of the retarding roller 14 in the passage between the non-operative open condition and the operative condition when the latter is at the desired distance Dmin from the feed roller 12.

According to some embodiments, on the end-of-travel portion 28 there can be abutment elements 29, for example electric switches or contact sensors, suitable to rest in contact with the stop portion 27 to reduce the wear on the end-of-travel portion 28 and/or the stop portion 27, and possibly cushion the collision between them due to the pressure exerted by the drive member 21.

According to some embodiments, the stop member 26 can be a motorized centesimal feeler, suitable to also define displacements in the range of hundredths of a millimeter, so that the desired minimum distance Dmin can be set with high precision.

According to some embodiments, the abutment member 22 can be a lever 25 constrained to a pin 30 which acts as a fulcrum, so as to be rotatable with respect to a first axis of rotation X1 passing through the pin 30 in the directions of rotation F1, F2 shown in FIGS. 1-3.

In accordance with some embodiments, the lever 25 can comprise a first arm 31 and a second arm 32 connected integrally to each other in correspondence with respective ends and both rotatable with respect to the pin 30.

According to possible embodiments, on a plane orthogonal to the first axis of rotation X1, the lever 25 can be L-shaped, where the first arm 31 is disposed substantially orthogonal to the second arm 32 in correspondence with the pin 30.

According to some embodiments, in correspondence with its free end, the first arm 31 is connected integrally with the retarding roller 14, for example in correspondence with the rotation shaft 33 of the latter. In this way, the rotation of the lever 25 around the pin 30 involves a correlated displacement of the rotation shaft 33 along an arc of the circumference C.

According to other embodiments, the second arm 32 is connected to the drive member 21.

The second arm 32 in particular is hinged to the drive member 21 and is rotatable relative to it around a second axis of rotation X2 substantially parallel to the first axis of rotation X1.

According to possible solutions, the second arm 32 is provided with the end-of-travel portion 28 in correspondence with its free end.

According to other embodiments, the drive member 21 is connected to, and acts on, an intermediate portion of the second arm 32 between the pin 30 and the end-of-travel portion 28.

According to the example embodiment shown in FIG. 3, when there is a seam in the fabric 11, the retarding roller 14 moves away from the feed roller 12, moving in the opening direction F1 toward the non-operative open condition. In this condition, the drive member 21 rotates the lever 25 in a concordant direction F1 by an angle correlated to that of the retarding roller 14, so that the end-of-travel portion 28 moves away from the stop portion 27.

Subsequently, the positioning device 20 moves the retarding roller 14 again and automatically to restore its operative condition, returning it to the operative distance Dop from the feed roller 12. In particular, the drive member 21 can be driven in such a way as to make the lever 25, and hence the rotation shaft 33 of the retarding roller 14 constrained to it, rotate in a closing direction F2 opposite the opening direction F1.

The drive member 21 in particular is driven until the end-of-travel portion 28 of the lever 25 goes into contact with the stop portion 27, thus defining the end of travel of the retarding roller 14.

In this way, it is possible to exert a high pressure, for example of 6 bars or more, such as to quickly restore the operative condition of the retarding roller 14 and at the same time preserve the rubber of the latter.

According to some embodiments, the position of the stop portion 27 can be regulated, for example, automatically, also depending on the type and/or thickness of the fabric 11 to be treated, or the degree of compaction required.

By way of example, FIG. 1 shows an operative condition of the positioning device 20 in the presence of a fabric 11 having a first thickness S1, wherein the distance between the feed roller 12 and the retarding roller 14 is, for example, equal to the minimum distance Dmin. In this case, the stop portion 27 is positioned at a first height H1, defining the safety height necessary to guarantee that the two rollers 12, 14 are never in contact with each other.

FIG. 2 shows a second operative condition of the positioning device 20 in the presence of a fabric 11 having a second thickness S2, bigger than the first thickness S1. In this case, the distance between the feed roller 12 and the retarding roller 14, for example, is equal to an operative distance Dop greater than the minimum distance Dmin. In this case, the stop portion 27 is positioned at a second height H2, different from the safety height, such as to define a lower travel for the drive member 21.

According to some embodiments, the compacting machine 10 also comprises a control and command unit 35, schematically shown in FIG. 3, provided with a user interface 36 by means of which an operator can select the desired operative distance Dop between the feed roller 12 and the retarding roller 14, so as to define the degree of compaction to be performed on the fabric 11.

The control and command unit 35 can be connected to the rotation shafts of the feed roller 12 and the retarding roller 14 in a known way, to regulate their respective speeds and/or detect their respective reciprocal positions.

The control and command unit 35 can also be connected to the positioning device 20 and configured to regulate it according to the operative distance Dop selected by the user.

In particular, the control and command unit 35 can regulate the position of the stop member 26 so as to position the stop portion 27 at an operative height correlated to the selected operative distance Dop.

Embodiments described here also concern a method for positioning the retarding roller 14 with respect to the feed roller 12, wherein the method provides to move the retarding roller 14 at least between a non-operative open condition in which it is distant from the feed roller 12 and an operative condition in which it is close to it.

According to some embodiments, the method comprises an initial setting step of a minimum distance Dmin between the retarding roller 14 and the feed roller 12.

According to some embodiments, in order to move the retarding roller 14 from the non-operative open condition to the operative condition, the method provides to drive the drive member 21 to move the abutment member 22 and hence the retarding roller 14 to the distance Dmin from the feed roller 12, that is, until the end-of-travel portion 28 is in contact with the stop portion 27.

According to some embodiments, the initial setting step can comprise:

positioning the retarding roller 14 parallel to, and in contact with, the feed roller 12 by the action of a drive member 21;

distancing the retarding roller 14 from the feed roller 12 by a desired minimum distance Dmin, positioning at a defined correlated height a stop portion 27 of a stop member 26 of the positioning device 20 cooperating with an abutment member 22, and setting said defined height as the safety height of the positioning device.

According to some embodiments, the method also provides a regulation step that comprises selecting an operative distance Dop between the feed roller 12 and the retarding roller 14, greater than or at most equal to the minimum distance Dmin, and the relative regulation of the stop member 26, in which the stop portion 27 of the stop member 26 is positioned, with respect to the set safety height, at an operative height correlated to the selected operative distance Dop.

It is clear that modifications and/or additions of parts can be made to the compacting machine 10, the positioning device 20 and the positioning method described heretofore, without departing from the field and scope of the present invention.

For example, in a substantially equivalent manner, the positioning device 20 could be connected to the feed roller 12 to move the latter with respect to the retarding roller 14.

It is also clear that, although the present invention has been described with reference to some specific examples, a person of skill in the art shall certainly be able to achieve many other equivalent forms of, compacting machine 10, positioning device 20 and positioning method, having the characteristics as set forth in the claims and hence all coming within the field of protection defined thereby.

The invention claimed is:

1. A compacting machine for compacting a fabric, comprising a feed roller, a retarding roller and a blade element configured to introduce said fabric to be treated between said feed roller and said retarding roller, wherein said compacting machine further comprises a positioning device provided with at least one drive member configured to move one of said rollers with respect to the other of said rollers, said positioning device also comprising an abutment member integral with one of the rollers, and a stop member positionable to cooperate with said abutment member so as to mechanically limit movement of one roller so that a desired distance other than zero is defined between one roller and the other roller, wherein said stop member is provided with a stop portion cooperating with an end-of-travel portion provided on said abutment member, wherein when said end-of-travel portion is in contact with said stop portion one of the rollers is at a minimum distance from the other of the rollers, wherein said end-of-travel portion is provided on a free end of said abutment member.

2. The machine as in claim 1, wherein said positioning device comprises two abutment members and two stop members, each disposed in correspondence with one end of one of said rollers, so as to guarantee that one of the rollers is positioned perfectly parallel to the other of said rollers.

3. The machine as in claim 1, wherein said stop member comprises means for moving said stop portion at least from a safety height, correlated to said minimum distance, to an operative height in order to set between said feed roller and said retarding roller an operative distance that is greater than said minimum distance.

4. The machine as in claim 1, wherein said stop member is a motorized centesimal feeler.

5. The machine as in claim 1, wherein said abutment member is a lever rotatable with respect to a pin, comprising a first arm and a second arm, integral with each other, said first arm being connected in an integrated manner to one of said rollers and said second arm being connected to said drive member.

6. The machine as in claim 1, further comprising a control and command unit functionally connected to said positioning device and provided with a user interface by means of which an operator can select a desired operative distance between said feed roller and said retarding roller, said control and command unit being configured to regulate said stop member so as to position said stop portion at an operative height correlated to said operative distance selected.

7. A positioning device for a compacting machine for fabrics provided with a feed roller and a retarding roller, said positioning device comprising a drive member configured to move one of said rollers with respect to the other of said rollers, wherein said positioning device also comprises an abutment member integral with one of the rollers, and a stop member positionable to cooperate with said abutment member so as to mechanically limit the movement of one roller so that a desired distance other than zero is defined between one roller and the other, wherein said stop member is provided with a stop portion cooperating with an end-of-travel portion provided on said abutment member, wherein when said end-of-travel portion is in contact with said stop portion one of the rollers is at a minimum distance from the other of the rollers, wherein said end-of-travel portion is provided on a free end of said abutment member.

8. A method to position a retarding roller with respect to a feed roller in a compacting machine for fabrics, comprising moving one of said rollers at least between a non-operative open condition in which one of said rollers is distant from the other of said rollers, and an operative condition in which one of said rollers is positioned close to the other of said rollers by means of a positioning device comprising a drive member, said positioning device also comprising an abutment member integral with one of said rollers, wherein said method further comprises an initial setting step including setting a minimum distance other than zero between said retarding roller and said feed roller, positioning a stop portion of a stop member of said positioning device at a defined height correlated to said minimum distance and wherein, in order to move one of said rollers from said non-operative open condition to said operative condition, said method includes driving said drive member to move one of said rollers until an end-of-travel portion provided on a free end of said abutment member interacts with said stop portion of said stop member.

9. The method as in claim 8, further comprising regulating an operative condition of one of said rollers with respect to the other roller, wherein said regulating step comprises the selection of an operative distance between said feed roller and said retarding roller, greater than or at least equal to said minimum distance, and the corresponding regulation of said stop member, wherein a stop portion of said stop member is positioned, with respect to said safety height set, at an operative height correlated to said operative distance selected.

* * * * *